United States Patent [19]

Chartet

[11] 3,939,908

[45] Feb. 24, 1976

[54] METHOD FOR EQUALIZING DIFFERENTIAL HEAT EXPANSIONS PRODUCED UPON OPERATION OF A HEAT EXCHANGER AND HEAT EXCHANGER EMBODYING SAID METHOD

[75] Inventor: André Chartet, Meudon, France

[73] Assignee: Societe Anonyme des Usines Chausson, Asnieres, Hauts de Seine, France

[22] Filed: Apr. 1, 1974

[21] Appl. No.: 456,886

[30] Foreign Application Priority Data

Apr. 4, 1973 France ..... 73.12174

[52] U.S. Cl. ..... 165/149; 165/152; 29/157.3 R

[51] Int. Cl.[2] ..... F28D 1/00

[58] Field of Search ..... 165/149, 152, 157; 29/157.3

[56] References Cited

UNITED STATES PATENTS

| | | | |
|---|---|---|---|
| 2,933,291 | 4/1960 | Huggins | 165/83 |
| 3,228,461 | 1/1966 | Seekins | 165/152 |
| 3,237,688 | 3/1966 | Huggins | 165/152 |
| 3,875,994 | 4/1975 | Lewakowski et al. | 29/157.3 R X |

FOREIGN PATENTS OR APPLICATIONS

| | | | |
|---|---|---|---|
| 1,272,995 | 8/1961 | France | 165/149 |

*Primary Examiner*—Albert W. Davis, Jr.
*Assistant Examiner*—James D. Liles
*Attorney, Agent, or Firm*—Browdy and Neimark

[57] ABSTRACT

Radiator comprising tubes, tube plates fitting ends of said tubes, lateral flanges and corrugated fins inserted between the tubes and between the tubes and the flanges. A bearing area is designed along the flanges or the tubes close to the tube plate for applying end fins between the flange and the adjacent tube. Means are designed for at least limiting joining portions of said fins extending at the level of said area.

27 Claims, 20 Drawing Figures

1
1b
5
5a
4d
22
23
7a
2
3
14
19
22a
4

METHOD FOR EQUALIZING DIFFERENTIAL HEAT EXPANSIONS PRODUCED UPON OPERATION OF A HEAT EXCHANGER AND HEAT EXCHANGER EMBODYING SAID METHOD

The invention relates to heat exchangers, especially those which are used for cooling liquids. In those apparatuses it is frequent that tubes are submitted to important heat shocks. In fact, on a motor-car and upon starting the engine, the radiator is at ambient temperature and is fed in cooling liquid only after the opening of a thermostatic valve isolating it from the cooling sleeves of the engine. Thus, the radiator which may be at a very low temperature, suddenly receives a liquid at a temperature of about 100°C. The radiator tubes being very thin are immediately heated and consequently become expanded. On the contrary, the lateral flanges, connecting the tube plates in which emerge the tubes, are heated only a long time later since they are not in direct heat contact with the liquid. Besides, their heat mass is notably more important than that of the tubes. On the other hand, the radiators comprise disturbers or corrugated fins placed between the end tubes and the flanges, these disturbers fins, besides acting as disturbing elements, constitute struts preventing distortion of the lateral walls of the tubes, said lateral walls being very thin could not stand, by themselves without risks of damage, the stresses due to the pressure of the liquid in circulation.

It has appeared that corrugated disturbers or fins, though being extremely thin, ensure a too rigid connection between the flanges and the lateral tubes of the radiator. Actually, in case of a more important heat expansion or shrinking of the tubes than of the flanges, the successive corrugations which are welded or brazed to the flanges as well as to the tubes cannot be distorted because they make a real triangulation between said tubes and said flanges. TThe expansion forces being obviously considerable, breakings of the tubes very often occur especially at the level of the tubes plates, which causes the heat-exchanger to leak. The above disadvantage is amplified by the cyclic succession of the heat expansions and shrinkings.

To try to cope with said disadvantage it has already been offered to reinforce the connection between the tubes and the tube plates but, it has then appeared that the wall of the tubes could itself be torn out. Also it has been offered to design, in the flanges, an expansion ring or a sliding link for the connection between the flange and the tube plate be not rigid. Said arrangement, which is satisfactory upon the brazing operation, is no longer satisfactory during the use of the heat exchanger since, as aforementioned, when an assembling through welding or brazing is realized, the fins act as a triangulated lattice, and the same disadvantages as the above mentioned ones are also present.

The present invention completely solves the problem.

According to the invention, the method for equalizing differential heat expansions produced upon operation of a heat exchanger of the type comprising tubes having ends fitted in two end plates and rigidly connected therewith lateral flanges and corrugated fins inserted between the tubes and between said tubes and the lateral flanges to form a unit, the unit being welded or brazed as a one-piece unit with the lateral flanges and tube plates rigidly connected together, is characterized by annihilating or at least limiting the connection between the flanges and the end tubes at least in portions thereof being close to each tube plate.

The invention also relates to a radiator embodying the above mentioned method.

According to this arrangement of the invention, a radiator for cooling a liquid and comprising tubes, tube plates in which are fitted ends of the said tubes, lateral flanges and corrugated fins inserted between said tubes and between said tubes and said flanges, is characterized by a bearing area designed along the flanges or the tubes at least on a limited length and close to the tube plates, said bearing area holding end fins applied between the flange and the nearest tubes, and means being designed for at least limiting joining portions of said fins extending at the level of said area while the flanges, the tube plates and the tubes are rigidly connected together.

Various other features of the invention are moreover shown in the following detailed description.

Embodiments of the invention are shown by way of nonrestrictive examples in the accompanying drawings, in which.

Figures 1, 2, 3, 4, 5, 6, 7, 8:
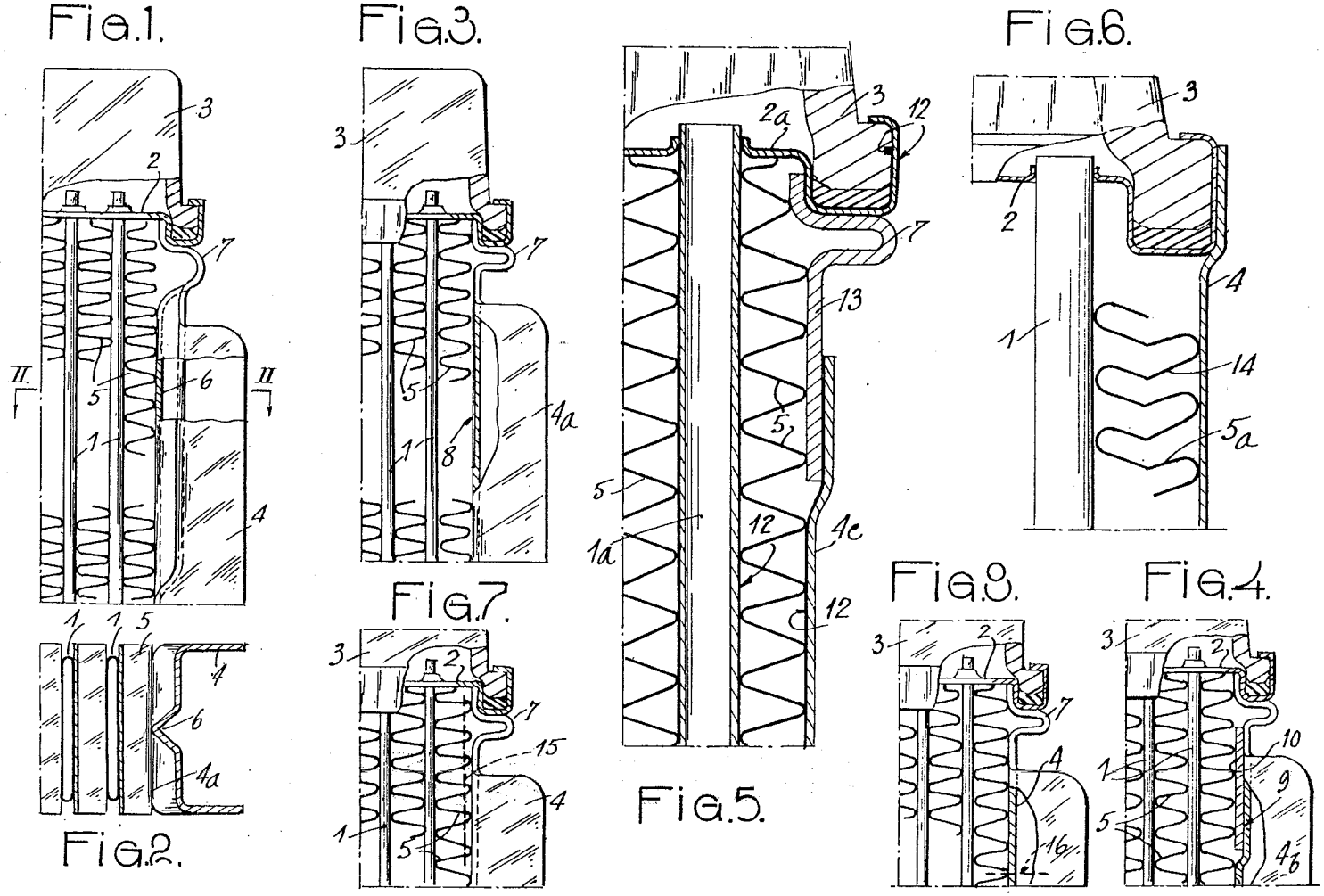
FIG. 1 is a fragmentary sectional elevation of a radiator embodying the invention.
FIG. 2 is a sectional view taken along line II—II of FIG. 1.
FIG. 3 is a sectional view similar to FIG. 1 of a first variant.
FIG. 4 is a diagrammatic sectional view of another variant.
FIGS. 5 and 6 are enlarged diagrammatic fragmentary sectional views of two other variants.
FIGS. 7 and 8 are diagrammatic sectional views of two further variants.

The drawings fragmentarily show a radiator for cooling liquid of a heat engine. Said radiator comprises circulation tubes 1 of which the ends are fitted in tube plates 2 of which only one is represented, said tube plates being covered with header boxes 3. Lateral flanges 4 are placed on the two lateral sides of the radiator, and fins 5 in the shape of corrugated fins are placed between the different tubes 1 and between said tubes and the flanges 4. The connection between the tubes 1, the fins 5, the tubes plates 2 and flanges 4 is made through welding or brazing depending on whether the parts are made of coppery or ferrous metals or of aluminous metals. What is explained hereinbelow relates to radiators made of heterogeneous metals and in which the tubes are made of brass or steel, the fins 5 are made of aluminum or copper and the flanges 4 are made of steel or aluminum. Also the tube plates can be made of steel, stainless steel, aluminum or copper and the nature of the constituting material of the header boxes can be of any kind: either of metals which can be welded or brazed to the tube plates, or of synthetic materials in which case the connection is made by mere mechanical means.

In FIGS. 1 and 2, the flange bears on the whole width thereof and on the main portion of its length against the fins which form intercalary part 5, as shown at 4*a*. Thus the pressure developed in the tubes by the circulating liquid is balanced by the fins and the flanges. In their upper and lower portions, the flanges bear against the last fin section only by one or several ribs 6. The rib 6 extends on a height which ranges between 3 to 25% of the tube length and preferably 10% of said length.

In addition, but this is not required, another element equalizing the expansion, for example, a loop 7 is designed close to at least one end of each flange 4. During the operation leading to welding or brazing of the different parts of the radiator, the differential heat expansions between the tubes are balanced by the loop 7. Then, the whole radiator forms a one-piece unit. During the operation of the radiator, the heat shocks, which are produced at the level of the tubes when very hot liquid is supplied to them upon opening of a thermostat regulating the cooling circuit, cause a sudden heat expansion of said tubes, while the flanges are not or very slightly expanded or, in any case are expanded with a certain delay relatively to the tubes. Due to the presence of the rib 6 which is the only part fixed to the upper and lower portions of the fins separating the flange from the first tube 1, said fins can be partly distorted, and a breaking can even occur between the fins and the flange. However, said breaking then occurs close to the rib 6, which is then not a trouble for the normal operation of the radiator because, even in the case of the breaking of the fins close to or at the level of the rib 6, said fins will keep on acting as a reinforcement of the lateral wall of the tube 1, lateral wall which must not expand under the effect of an internal pressure of the fluid circulating in the tube.

According to the variant shown in FIG. 3, the flange 4*a* is continuous and does not have any longer the rib 6. In that case an intercalary screen 8, very thin, for example a few hundredth of millimeters, is inserted between the flange 4*a* and the fin 5, said intercalary screen extending like the rib 6 on a length within 3 and 25% of that of the tube. The screen is realized, as shown, by a band 8 made of a material which prevents welding or brazing of the corresponding portion of the flange and of the intercalary part. A particular resin can be used, as well as a very thin sheet of a metal or ink preventing the brazing. Thus, the fins 5 are welded or brazed both to the tube and to the flange except at the level of the intercalary screen 8, which enables the tube, upon heat shocks, to expand differentially relatively to the flange.

FIG. 4 shows a development of FIG. 3 wherein both the upper portion and the lower portion of the flange 4*b* have a separation 9 still extending within 3 to 25% of the tube length, said separation being used as a housing for a small plate 10 selected as for not being brazed either to the flange or to the fins 5; thus fins 5 can slide in relation with the small plate 10 if it is not brazed thereto or, on the contrary it is the small plate which can slide in the separation 9.

FIG. 5 shows an embodiment more especially designed to be used in radiators made of aluminous metals. In that case tubes 1*a* are used which are outsidely covered with a plating 12 of a brazing alloy, the tube plates 2*a* being covered on their two sides with the same plating 12 while the flange 4c is also covered on its inner side with said plating 12. The fins 5 are not covered with plating and an intermediate lug 13 is designed to connect the flange 4*c* to the tube plate 2*a*, said intermediate lug being not covered with plating and being possibly provided with the loop 7 balancing or compensating the heat expansion. It can be seen that through this embodiment, when the radiator is finished, the brazing is performed between the tubes and the tube plates, between the tubes and the fins, between each lug 13 and the flanges and between the fins and said flanges, except for portion of the fins bearing against the lug.

According to FIG. 6, the tubes 1, tubeplates 2 and flanges 4 are normally manufactured and assembled, but the fins, then designated by 5*a*, are shaped in such a way that their successive corrugations be not rectilinear but, on the contrary, delimit curves 14. Thus, upon the differential heat expansions between the tubes and the flanges, these are the fins which are distorted.

FIGS. 7 and 8 show how the invention can be embodied in already existing radiators. In such a case, according to FIG. 7, a saw-cut 15 is made in the portion of the fins 5 which are in the vicinity of each flange 4, this saw-cut extending on a length within 3 to 25% and preferably 10% of the length of the tubes.

In FIG. 8, saw-cuts 16 are made in the flange 4, transversely to said flange, thus the tubes can also expand differentially with respect to said flange. If desired, several saw-cuts can be made one above each other, each saw-cut approximately extending in a direction transverse to the flange, but not concerning the whole width of said flange. Thus, the flange can then be distorted at the same time as the fins.

Figures 9, 10, 11, 12, 13:
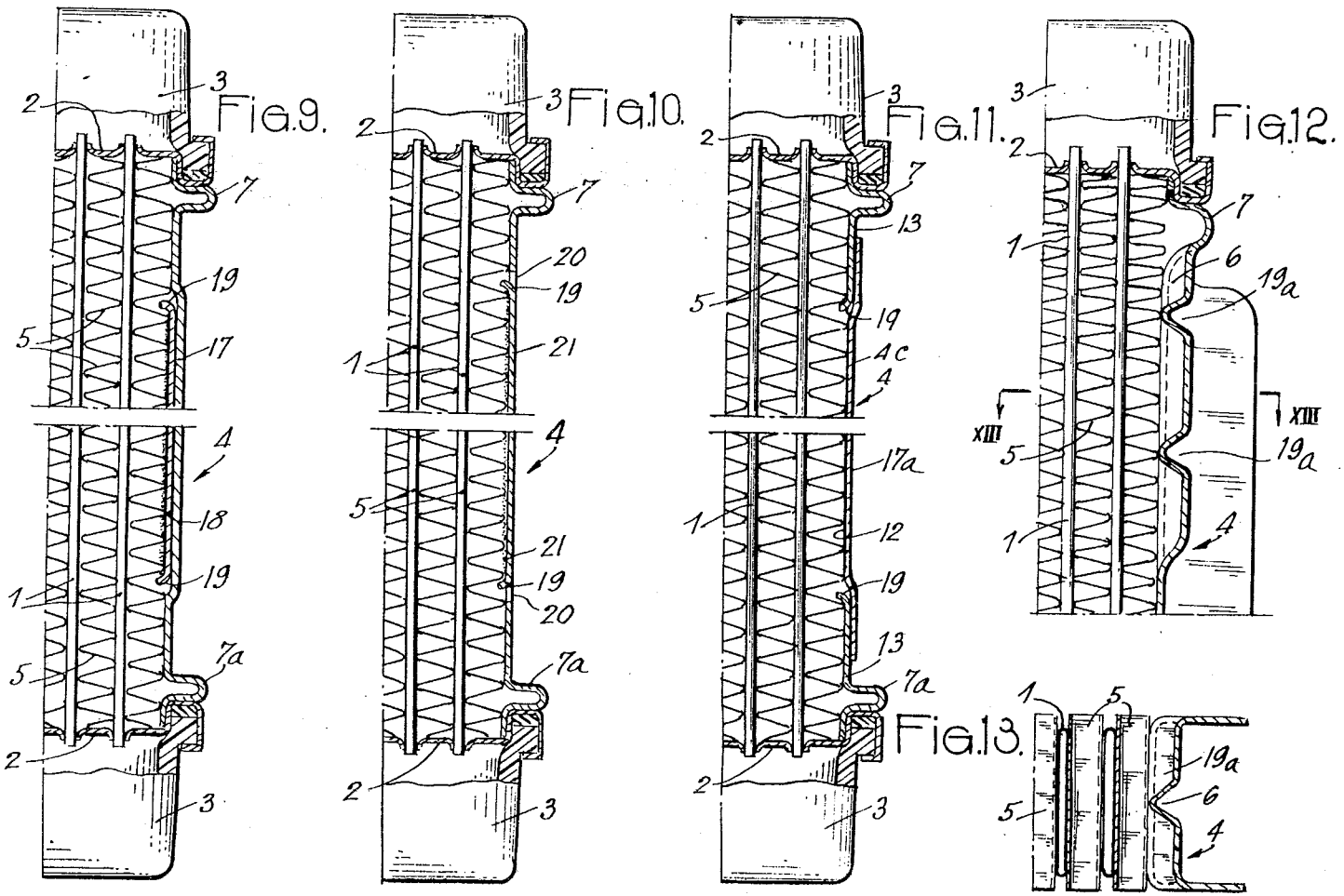
FIGS. 9 to 12 and 14, 15 are fragmentary sectional elevations similar to FIG. 1 and showing different variants of realization.
FIG. 13 is a sectional view taken along line XIII—XIII of FIG. 12.

In FIG. 9, each flange 4 delimits on a portion of its length a groove 17, and said flanges are made of plain metal, that is of metal not covered with brazing alloy. The groove 17 is used as a housing for a plate 18 made of metal covered on its two sides with brazing alloy. The thickness of the plate 18 is equal to the depth of the groove 17, thus the fin 5 fixed to the first tube 1 bears, by all its corrugations, against the flange 4 or against the plate 18. Since the plate 18 is covered with a brazing alloy at the moment when the radiator is brazed, said plate is also brazed both to the fin 5 and to the flange 4. On the contrary, the portions of the fin 5 which bear directly against the metal of the flange are not brazed to said flange. As previously and in the following disclosure, the lengths of flanges which are not brazed to the fins ranges within 3 and 25% of the length of the tubes.

The radiators being usually brazed in a vertical position, according to an additional feature of the invention, it is designed, preferably at the lower portion of the plate 18, a retaining nose 19 forming a path of flow in the way that the liquid brazing can follow when tending to flow. Thus the brazing alloy, while flowing, cannot connect the flange 4 to the portion of fin 5 which extends beneath the plate 18. The retaining nose 19 also prevents that brazing run-outs could come into the heat expansion balancing element 7*a* as it could otherwise happen in making said element inoperative.

It is advantageous that the plate 18 will comprise a retaining nose 19 at each of its ends to avoid any preferential hanging way for the radiator when it is to be submitted to brazing operations.

In FIG. 10, the flanges 4 bear on their whole length against the fins 5 without said flanges being provided with the groove 17 as in FIG. 9.

Retaining noses 19 are formed by the flange itself, for example through folded back lugs from punctures 20, and a brazing alloy plating 21 is only provided between the retaining noses 19.

In FIG. 11, the flange is provided with intermediate lugs 13 comprising the heat expansion equalizing element 7, said lugs being designed to be brazed to the tube plates 2 which are covered with brazing alloys. The lugs 13, which have no brazing alloy, are connected together through the flange 4*c* which has an outer groove 17*a* to compensate the thickness of the lugs 13, the flange 4*c* being entirely covered with brazing alloy, as shown in 12. The ends of the lugs 13 are folded back to form the retaining nose 19.

In FIGS. 12 and 13, the flange bears on its whole width and the main portion of its length against the fins 5. In their end portions, the flanges bear against said fins only by a rib 6. To prevent the brazing alloy which normally covers the flange to flow towards the heat expansion equalizing element 7, said flange has also one or several retaining noses which, in such a case, are formed by moldings 19*a* protruding in a direction substantially transverse to that of the rib 6.

Figures 14, 15, 16, 17, 18:
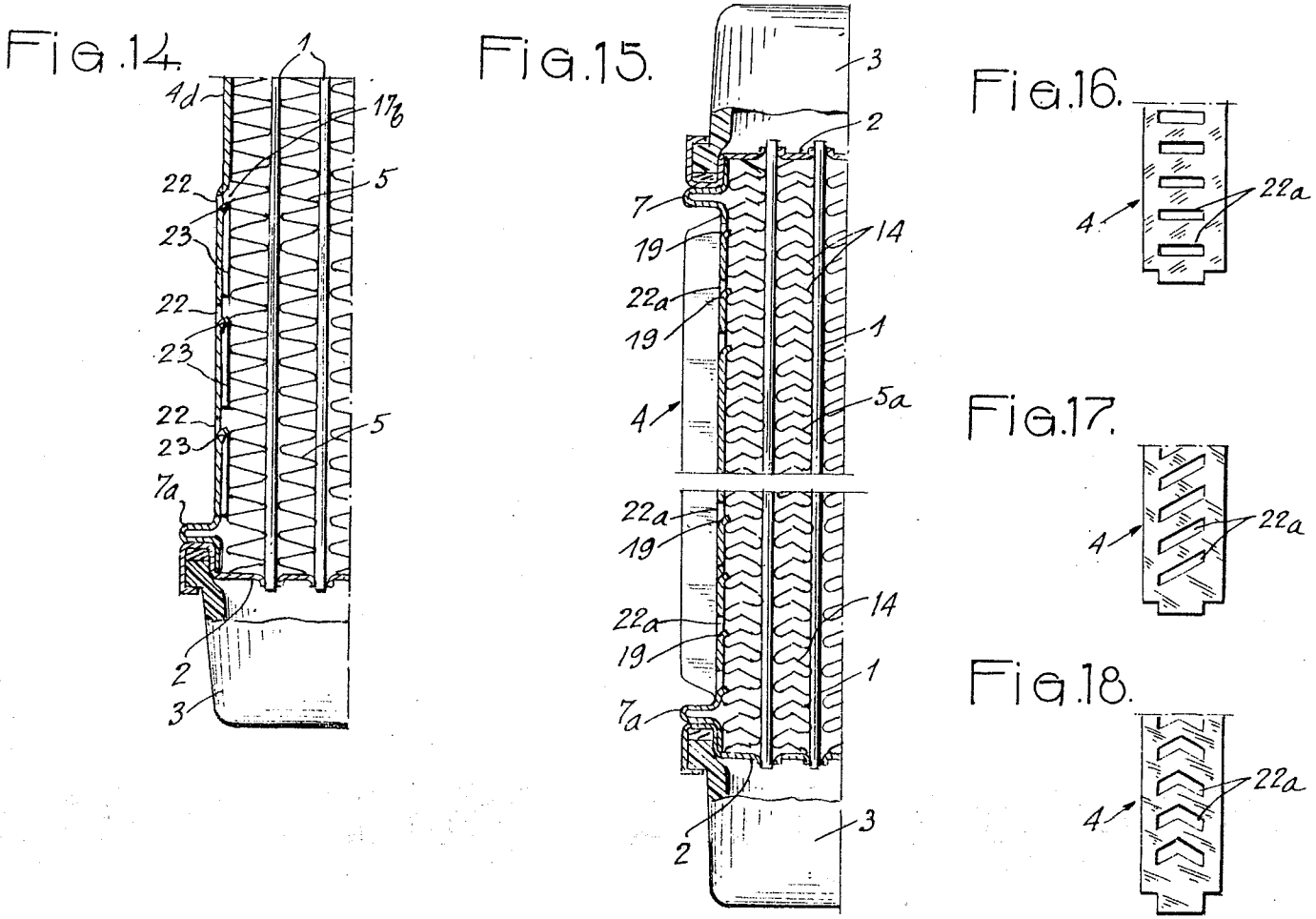
FIGS. 16 to 18 are fragmentary elevations showing different embodiments of a detail of realization appearing in FIGS. 14 and 15.

In FIG. 14, the flanges 4 form a bearing portion 4*d* and, on each side thereof, they delimit grooves 17*b* in which are made apertures 22 which, preferably, extend diagonally as shown in FIG. 17 or which are shaped as chevrons as shown in FIG. 18.

Lugs 23 are cambered along the apertures 22 to constitute bearing areas of small surface against which are bearing the ends of the fins 5. In this embodiment, the side of the flange facing the fins 5 can be covered with brazing alloy and said brazing alloy is prevented from flowing towards the heat expansion equalizing elements 7 by the apertures 22 delimiting a path of flow in a direction that can follow the melting brazing alloys while the cambered lugs 23 form, due to their diagonal direction, bearing areas for the end fin sections. It is also possible, in this embodiment, that the brazing alloy covers only the bearing portion 4*d* of the flange, as described in the above disclosure with reference to FIG. 10.

According to FIG. 15, the disturbers then constited by the fin 5*a* are shaped to prevent their successive corrugations to be rectilinear, and on the contrary they delimit curves 14. Thus, upon the differential heat expansions between the tubes and the flanges, these are the fins which are distorted at the level of their curve. In view of preventing the brazing alloy covering the flange to make inoperative the heat expansion equalizing elements 7, means are as previously designed at the two ends of each flange for introducing a path of flow in a direction that can be followed by the melting brazing alloy; these means are constituted by apertures 22*a* from which retaining noses 19 are upwardly folded.

The apertures 22*a* can be horizontally extended as shown in FIG. 16, though they can be also inclined, or chevronshaped as shown in FIGS. 17 and 18.

Figure 19:
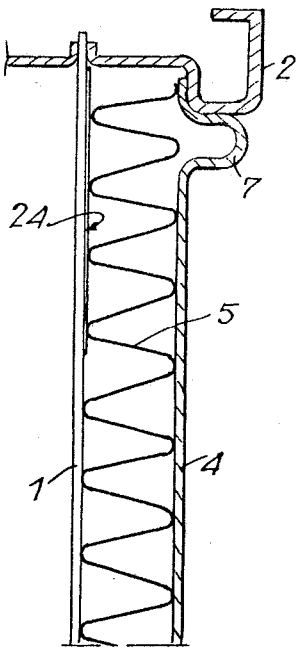
FIGS. 19 and 20 are sectional elevations of still other variants.

According to FIG. 19, the end tubes 1, which are covered with a brazing alloy, as in the above disclosure, are provided, at their end portions and on their side directed towards the end fin 5, with screens 24 respectively extending within 3 to 25% of their length.

Figure 20:
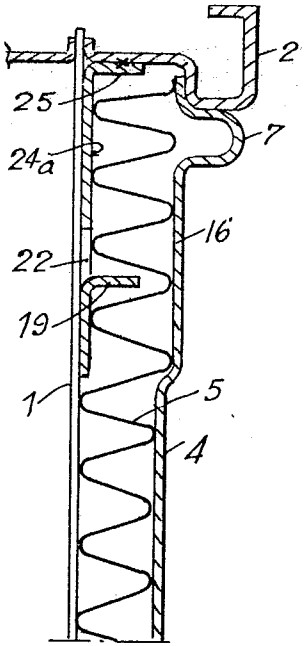

In FIG. 20, the screen 24*a* is constituted by a small metal plate which is not covered with brazing alloy and which has a tongue 25 bearing against the tube plate 2 covered with brazing alloy in the very same way as the tubes 1. A retaining nose 19 and an aperture 22 are also provided in the small plate forming the screen to prevent the flow of the brazing alloy. In this embodiment, the screen is not brazed to the end fin but is brazed to the tube and thus constitutes a reinforcement for said tube. Besides, a groove 26 is designed at each end of the flanges 4 to compensate the thickness of the small plate, the depth thereof being small to enable the fin to be suitably brazed to the flanges on the whole length thereof.

I claim:

1. A method for compensating differential heat expansions produced upon operation of a heat exchanger of the type having inner tubes and end tubes, tube plates fitting ends of said tubes, and rigidly connected therewith, lateral flanges, and corrugated fins inserted between the tubes and between said tubes and the lateral flanges to form a unit, comprising the steps of welding or brazing as a one-piece unit with said lateral flanges and tube-plates rigidly connected together, and providing means for precluding bonding between said lateral flanges and said fins in the proximate area of said tube-plates wherein the connection of said end tubes to said lateral flanges through said fins in the proximate area of said tube plates is non-bonded.

2. Method for compensating differential heat expansions as set forth in claim 1 wherein the non-bonded area is limited to an area extending from the tube plates and having a length within 3 and 25% of the length of the tubes.

3. Method as set forth in claim 2, wherein is created at least one flow path close to the area of the non-bonded connection between the flanges and the end tubes, whereby said flow path substantially prevents flow of any liquid brazing material to said non-bonded connection upon brazing of the radiator.

4. Method as set forth in claim 3, wherein the flow path is designed in a direction substantially transverse to the flanges when the radiators are held in a substantially vertical position upon the brazing operation.

5. Method as set forth in claim 1, wherein distortion areas are formed in the flanges close to their junction with each tube plate, whereby equalizing axial expansion differences between said flanges and the tubes.

6. A radiator for cooling a liquid, comprising inner and outer tubes, tube plates fitting ends of said tubes and rigidly connected therewith, lateral flanges, corrugated fins inserted between said inner tubes, said end tubes, and said lateral flanges, a bearing area along said lateral flanges and said end tubes in the proximate area of said tube plates, and means for limiting the joining portions of said fins extending at the level of said bearing area, wherein said bearing area holds said fins between said end tubes and said lateral flanges in a non-bonded condition.

7. A radiator as set forth in claim 6, wherein said bearing area extends for a length within 3 to 25% of the length of the tubes and preferably 10% of said length.

8. A radiator as set forth in claim 6, wherein said bearing area is delimited by at least a longitudinal rib formed by the lateral flange at its end portions and extending the normal bearing area of said flange.

9. A radiator as set forth in claim 6, wherein said bearing area is delimited by a screen placed between the lateral flange and a contiguous fin, said screen preventing welding or brazing of said fin to said flange.

10. A radiator as set forth in claim 9, wherein the screen is constituted by an interralary screen.

11. A radiator as set forth in claim 9, wherein the screen is constituted by a small plate placed in a cavity of the lateral flange.

12. A radiator as set forth in claim 6, wherein said bearing area is delimited by a lug placed between the end of said lateral flange and said tube plate, said lug being physically joined both to said tube plate and to said lateral flange but not to said fin.

13. A radiator as set forth in claim 6, wherein said bearing area is delimited by a saw-cut made in the fin close to fin flange.

14. A radiator as set forth in claim 6, wherein said bearing area is delimited by saw-cuts made transversely in said lateral flange.

15. A radiator as set forth in claim 6, wherein said bearing area is delimited by curved portions formed in successive corrugations of the fin.

16. A radiator as set forth in claim 6, comprising at least a nose or other protruding element forming a flow path in each flange beyond the limit of the area in which the corrugated fins are rigidly connected to said flange or to the tubes.

17. A radiator as set forth in claim 16, wherein the element forming a flow path is delimited at least at one of the ends of a plate covered on two sides thereof with a brazing alloy and housed into a groove provided by each flange made of metal not covered with brazing alloy and delimiting, on each side of said groove, a bearing area holding the fins connected to the wall of the nearest tube.

18. A radiator as set forth in claim 16, wherein the elements forming the flow path are constituted by lugs delimited from punctures formed in the bearing area of the lateral flange which is covered with brazing alloy only in portion thereof extending between said lugs.

19. A radiator as set forth in claim 16, wherein the elements forming the flow path are made at the end of lugs not covered with brazing delimiting the bearing areas of the lateral flanges on the ends of the corrugated fin, said lugs being connected together by a portion of said flange covered with brazing alloy and delimiting a groove compensating the thickness of said lugs in portion thereof not connected to said lugs.

20. A radiator as set forth in claim 16, wherein the elements forming the flow path are constituted by at least one molding element transverse to a longitudinal rib having a top delimiting the bearing area holding the ends of the fins against the wall of the end tubes.

21. A radiator as set forth in claim 16, wherein the elements forming the flow path are constituted by lugs cambered from the edge of the diagonal transverse apertures, formed at the ends of each flange of which a side turned towards the fin is at least partly covered with brazing alloy.

22. A radiator as set forth in claim 6, wherein said fins are brazed on the whole height of said lateral flanges and on only a portion of the tubes which are the nearest ones to the said flanges, thus said fins are removable from said tubes in portions thereof which are close to the tube plates.

23. A radiator as set forth in claim 22, wherein screens are placed between each end fin and each end tube is covered with brazing alloy.

24. A radiator as set forth in claim 23, wherein the screens are constituted by a small metal plate not covered with brazing alloy and which is fixed to said end tube by means of the brazing alloy covering said tube, said end small plate forming further a retaining nose for the brazing alloy and a brazed reinforced lug for the tube plate.

25. A method for compensating differential heat expansion produced upon operation of a heat exchanger, said heat exchanger comprising inner tubes and end tubes, tube plates fitting ends of said tubes, lateral flanges, and corrugated fins inserted respectively between said tubes and between the lateral flanges and end tubes located adjacent to said lateral flanges, comprising the steps of:

providing brazing material on portions of at least said tube plates, said inner tubes, said end tubes and said lateral flanges;

limiting the introduction of brazing material between the lateral flanges and each end tube located adjacent said lateral flanges at least on portions thereof being close to each tube plate; and submitting the heat exchanger to brazing;

whereby said tubes and tube-plates are rigidly connected, said tube plates and lateral flanges are also rigidly connected thus forming a frame and said tubes and corrugated fins inserted therebetween are also rigidly connected while at least a limited connection remains between the lateral flanges and portions at least of the end tubes adjacent to said lateral flanges.

26. A heat exchanger comprising inner tubes and end tubes, tube-plates fitting ends of said tubes, lateral flanges and corrugated fins inserted respectively between said tubes and between the flanges and end tubes located adjacent to said lateral flanges, wherein:

the tubes are rigidly connected to the tube plates and said tube plates are rigidly connected to the flanges to form a rigid frame;

the tubes are rigidly connected to the corrugated fins inserted between said tubes; and means are provided for limiting connection through the respective corrugated fins between the lateral flanges and portions of the end tubes adjacent to said lateral flanges.

27. A radiator as set forth in claim 16, wherein the elements forming the flow path are constituted by lugs in the shape of chevrons formed at the ends of each flange of which a side turned towards the fin is at least partly covered with brazing alloy.

* * * * *

UNITED STATES PATENT AND TRADEMARK OFFICE

CERTIFICATE OF CORRECTION

PATENT NO. : 3,939,908

DATED : February 24, 1976

INVENTOR(S) : Andre Chartet

It is certified that error appears in the above-identified patent and that said Letters Patent are hereby corrected as shown below:

Column 7, line 7, insert --part-- after "fin"
line 8, delete "fin" and insert --said lateral--

Signed and Sealed this

Twentieth Day of July 1976

[SEAL]

*Attest:*

RUTH C. MASON
*Attesting Officer*

C. MARSHALL DANN
*Commissioner of Patents and Trademarks*